United States Patent [19]

Franke et al.

[11] 4,212,631

[45] Jul. 15, 1980

[54] TONER FUSING ARRANGEMENT

[75] Inventors: Walter Franke, Bad Aibling; Ottmar Wolf, Munich, both of Fed. Rep. of Germany

[73] Assignee: Agfa-Gevaert AG, Leverkusen, Fed. Rep. of Germany

[21] Appl. No.: 948,326

[22] Filed: Oct. 4, 1978

[30] Foreign Application Priority Data

Oct. 22, 1977 [DE] Fed. Rep. of Germany ..... 2747544

[51] Int. Cl.[2] ..... H05B 3/10; G03G 15/20

[52] U.S. Cl. ..... 432/60; 355/3 FU; 219/216; 219/469

[58] Field of Search ..... 432/59, 60, 228; 219/216, 469; 355/3 FU

[56] References Cited

U.S. PATENT DOCUMENTS

| | | | |
|---|---|---|---|
| 3,754,819 | 8/1973 | Braun | 432/60 |
| 3,874,843 | 4/1975 | Fujimoto et al. | 432/60 |
| 3,998,584 | 12/1976 | Wada et al. | 432/60 |
| 4,119,831 | 10/1978 | Sato | 432/60 |
| 4,147,501 | 4/1979 | Goshima et al. | 432/60 |
| 4,154,575 | 5/1979 | Edwards et al. | 432/60 |

*Primary Examiner*—Henry C. Yuen
*Attorney, Agent, or Firm*—Michael J. Striker

[57] ABSTRACT

A positively heated fusing roller and a not positively heated counterpressure roller define a roller nip through which copy paper bearing toner images to be fused is transported, with the toner images in contact with the peripheral surface of the heated fusing roller. The two rollers are driven by a drive mechanism during copying operations but not driven by that drive mechanism during the intermediate ready intervals during which the copying machine is awaiting a copying command from the operator. Because the fusing roller radiates heat to the counterpressure roller during the ready intervals, there is a tendency for the peripheral surface of the counterpressure roller to become non-uniformly heated, which can result in non-uniform fusing of toner along the length of the transported copy paper. In accordance with the present invention, at least the not positively heated counterpressure roller is automatically rotated during the ready intervals, preferably at a speed lower than the speed at which the rollers rotate during copying and fusing.

8 Claims, 2 Drawing Figures

TONER FUSING ARRANGEMENT

BACKGROUND OF THE INVENTION

The present invention concerns toner fusing arrangements which fix xerographic toner images on copy paper by means of a heated fusing roller and an unheated counterpressure roller which can be swung towards and away from the heated fusing roller, the copy paper whose toner image is to be fused being transported through the nip between the two rollers, with the toner image itself being contacted by the peripheral surface of the heated fusing roller.

Such toner fusing arrangements are known, for example, from Federal Republic of Germany published patent application Nos. 25 28 107 and 25 29 765. These are a great deal simpler and more reliable in operation than other conventional fixing arrangements of the type wherein both of the two rollers are positively heated by means of heating elements or IR radiators located interiorly or exteriorly of the rollers. In both cases, the copying machine is not ready to perform fixing operations until the peripheral surfaces of both rollers have reached the temperatures required for a fixing operation. The peripheral surface of the unheated (or not positively heated) counterpressure roller does not as a rule come into surface contact with the peripheral surface of the positively heated fusing roller, during the warm-up or starting time interval of the fusing arrangement. Instead the peripheral surface of the unheated counterpressure roller, and in particular the part of such surface facing the heated fusing roller, heats up due to radiation of heat from the positively heated fusing roller. When now the counterpressure roller is swung towards the fusing roller for performance of a fixing operation, the differently heated sectors of the peripheral surface of the not positively heated counterpressure roller contact successive sectors of the peripheral surface of the heated fusing roller, and cool the successive sectors of the fusing roller to differing respective degrees. To prevent the toner image from being differently fused at different locations along the length of the copy paper fed through the rollers, it is necessary to heat the fusing roller to a considerably greater and more energy-consumptive extent than would otherwise be necessary; otherwise, a so-called cold-setting of toner particles may occur at longitudinally spaced locations on the transported copy sheet.

SUMMARY OF THE INVENTION

It is the general object of the present invention to provide a toner fixing arrangement of the type described above, but modified to avoid the problem in question in a simple and inexpensive way.

In accordance with the inventive concept, this is achieved by rotating the not positively heated counterpressure roller during the ready intervals intermediate successive copying operations. Thus, during the time intervals during which in the prior art the counterpressure roller would not rotate, in accordance with the present invention the counterpressure roller continues to turn. For example, the counterpressure roller may be provided with a drive unit of its own, e.g., a driven friction roller against which the peripheral surface of the counterpressure roller engages when the counterpressure roller is swung away from the heated fusing roller.

With this arrangement, the slowly turning counterpressure roller can be uniformly heated during the preheating interval of the fusing arrangement, thereby achieving a uniform cooling down of the peripheral surface of the fusing roller during actual fusing operation and preventing insufficient warming of longitudinally spaced locations of the toner image on the copy sheet transported between the two rollers.

Tests have established that the uniformity with which the surfaces of the two rollers are heated up can be even further improved by rotating not only the counterpressure roller but additionally the heated fusing roller itself during the intervals intermediate copying operations, i.e., during the intervals during which in the prior art both the heated fusing roller and the unheated counterpressure roller would be non-rotating.

In principle, both the slow rotation of one or both of these rollers during the ready intervals between copying operations, and also the higher-speed rotation of these two rollers during actual fixing operations, could be derived from the drive unit of the copying machine through the intermediary of controllable couplings. Preferably, however, an auxiliary drive unit is utilized to provide rotation during the ready intervals. Advantageously, the lower-speed drive unit for the counterpressure roller, and possibly also for the heated fusing roller if the latter is also to be rotated, is coupled via an overruning clutch to at least one of the two rollers, and the higher-speed drive unit which drives the rollers during actual copying or fixing operations is likewise coupled to the rollers through the intermediary of an overrunning clutch.

Utilizing this technique, the higher-speed drive unit drives the rollers at higher speed during actual fixing operations, without requiring that the lower-speed drive unit, which is used to slowly turn the roller(s) intermediate copying operations, be decoupled or deenergized. Also, if a sheet of paper becomes jammed between the rollers after termination of a copying operation, i.e., during rotation of the slowly turning roller(s) under the action of the lower-speed drive unit, the overrunning coupling for the lower-speed drive unit permits the operator, even with the lower-speed drive unit running and coupled, to pull out the jammed sheet in a sense causing the two rollers to be turned in the direction opposite to that in which they are driven by the lower-speed drive unit.

To avoid the need for special couplings and a step-down transmission for the lower-speed continuous drive unit, it is also contemplated to provide the lower-speed drive unit with a drive motor of its own, this auxiliary drive motor furthermore being deenergized during actual copying and fixing operations in order to minimize the wear upon it.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
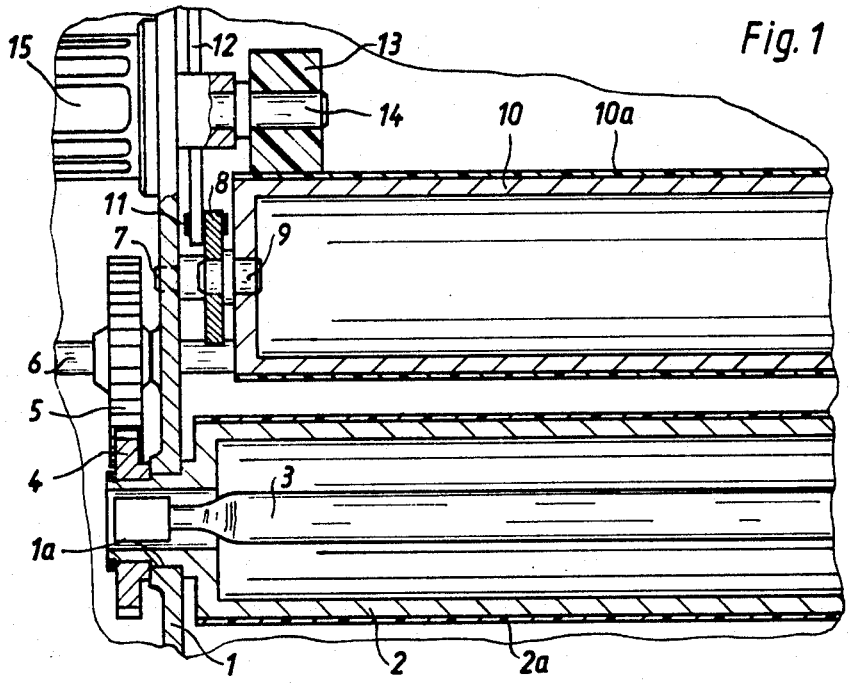
FIG. 1 is a longitudinal section through a first embodiment of the inventive toner fusing arrangement.

In the embodiment depicted in FIG. 1, the frame 1 of a copying machine has a mounting bore 1*a* in which is journalled a heated fusing roller 2 which, in per se conventional manner, is provided with a coating 2*a*, e.g., made of silicon rubber, which prevents fusible toner particles from clinging to the surface of fusing roller 2. A quartz radiator 3 is located in the interior of fusing roller 2 and heats it from within.

One end of roller 2 carries a gear 4 meshing with a gear 5 provided on a drive shaft 6. When the operator of the copying machine presses the start button to initiate copying, then in per se conventional manner the drive shaft 6 becomes coupled to the main drive mechanism of the copying machine and begins to transmit to fusing roller 2 the rotation needed to perform a fusing operation.

Also mounted on the copying machine framework 1 are the swing pins 7 of two swing plates 8 located at respective axial ends of a not positively heated counterpressure roller 10, whose mounting pins 9 are accommodated in the swing plates 8. The counterpressure roller 10 is provided with an elastic coating 10*a*. A coupling rod 11 couples a pull rod 12 to the illustrated swing plate 8, the coupling rod being for example the armature or coupled to the armature of an non-illustrated electromagnet which can be activated and deactivated for swinging counterpressure roller towards and away from the heated fusing roller 2. In such fusing arrangements, a biasing spring arrangement typically urges the counterpressure roller 10 into surface contact with fusing roller 2, when the counterpressure roller has been swung into engagement with the fusing roller, to assure that a sheet of copy paper transported through the nip between rollers 2, 10 is reliably engaged and transported. In that event, the unfixed toner image on the sheet of copy paper contacts the hot peripheral surface of fusing roller 2 and is fused onto the copy paper. Even in the prior art, the heated peripheral surface of the counterpressure roller 10, or more precisely that sector thereof which has been heated by radiation of heat from roller 2, also cooperates in the fusing operation. However, in accordance with the present invention, to assure that the heating up of the surface of counterpressure roller 10 is uniform all around the circumference of that surface, the roller 10, when swung away from fusing roller 2, bears against and is driven by a friction roller 13. Friction roller 13 is mounted on the output shaft 14 of an auxiliary drive motor 15. The rotary speed of motor 15 is so selected that, when the counterpressure roller 10 engages friction roller 13, roller 10 is rotated at low speed. Accordingly, during the ready intervals intermediate copying operations, i.e., during those intervals at which the copying machine is awaiting a copying command, successive angular sectors of the peripheral surface of counterpressure roller 10 move into a position facing the heated fusing roller 2. In this way, it is assured that the surface of counterpressure roller 10 is uniformly heated all about its circumference.

Figure 2:
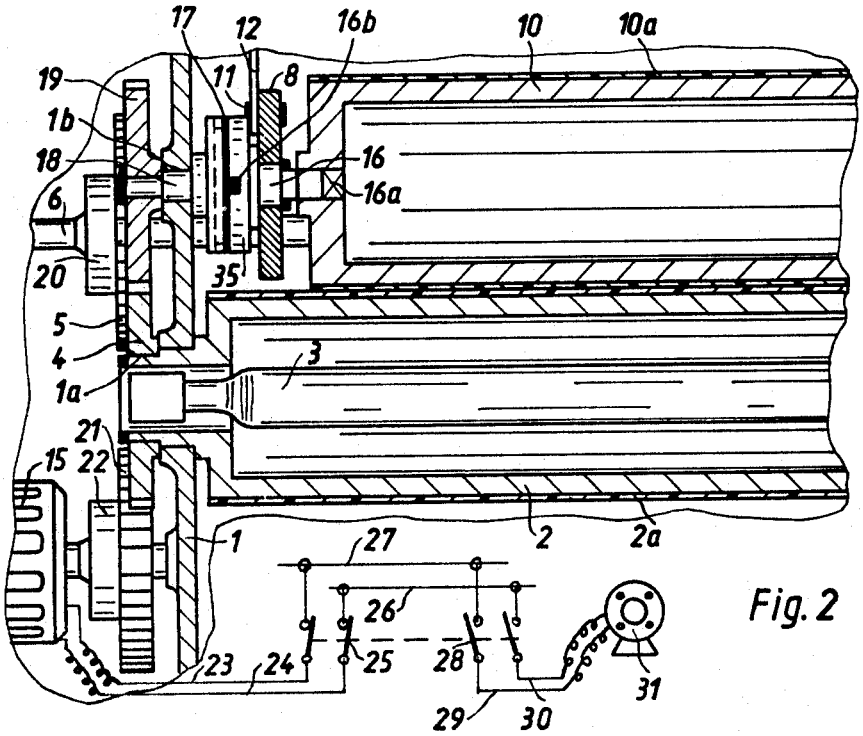
FIG. 2 is a section through a second embodiment, provided with an auxiliary drive motor for the two rollers.

In the embodiment depicted in FIG. 2, the counterpressure roller 10 is again journalled in swing plates 8 and can be swung towards and into engagement with fusing roller 2 and then swung away from roller 2. Here, however, the counterpressure roller 10 is rotated through the intermediary of an Oldham coupling 35. Oldham couplings are standard components in machine technology and serve to transmit rotation from one to the other of two non-aligned rotary shafts. Here, the Oldham coupling 35 comprises a mounting pin 16 mounted on the illustrated swing plate 8, the mounting pin 16 terminating at its right end in a section 16*a* of square transverse cross section non-rotatably received in the counterpressure roller 10, i.e. for transmitting rotation thereto, and also a shiftable coupling member 17 to which the mounting pin 16 is non-rotatably coupled, i.e., for transmitting rotation, via a slot 16*b*. Coupling member 17, in turn, engages in a slit in a mounting pin 18 via sliding elements formed on the coupling member.

The mounting pin 18 is mounted in a bore 1*b* of the machine framework 1 and carries a counterpressure-roller drive gear 19 which meshes with the drive gear 4 for the fusing roller 2. The drive gear 4 meshes above with the gear 5 driven by shaft 6 during copying operations, i.e., the drive gear 4 of roller 2 is located forwardly of the gear 5 of drive shaft 6 as viewed in FIG. 2. In contrast to the embodiment of FIG. 1, here the connection between the shaft 6 and the gear 5 includes an overrunning or oneway clutch 20. As described further below, the drive gear 4 for fusing roller 2 can also be driven by an auxiliary drive motor 15. When, of drive shaft 6 and auxiliary drive motor 15, it is the drive shaft 6 which tries to impart the higher rotary speed to the rollers 2 and 10, then it is drive shaft 6 which drives the rollers. When, of drive shaft 6 and auxiliary drive motor 15, it is the latter which tries to impart the higher rotary speed to the rollers 2 and 10, then it is auxiliary drive motor 15 which drives the rollers. Thus, when the drive shaft 6 is decoupled from the main drive mechanism of the copying machine, i.e., during the ready intervals during which the machine is awaiting a copying command from the operator, the auxiliary drive motor 15 automatically commences to drive fusing roller 2 and counterpressure roller 10 at a rotary speed lower than that established by drive shaft 6 during actual copying and fusing. In particular, the drive gear 4 for fusing roller 2 is driven by the motor 15 via a gear 21 and drives the drive gear 19 for counterpressure roller 10. Gear 21 is coupled to auxiliary drive motor 15 via a second overrunning or one-way clutch 22. Accordingly, if it is necessary to remove a sheet of copy paper from between rollers 2, 10 while these rollers are being driven by motor 15, the operator can pull the sheet out in a sense causing the rollers 2, 10 to turn in the direction opposite to that in which they are now being driven by motor 15; i.e., the sheet can be pulled out with auxiliary drive motor 15 running.

At the bottom of FIG. 2 a circuit diagram depicts how the auxiliary drive motor 15 is energized, for low-speed turning of rollers 2 and 10, via lines 23, 24 connected via a switch 25 to power-supply lines 26, 27. When switch 25 is closed a second switch 28 is opened, and vice versa. Switch 28 is connected in lines 29, 30 to the main drive mechanism of the copying machine, here represented by a motor 31, e.g., the motor driving the copying drum of the machine; it will be understood however that, in many such machines, 31 would be an electromagnetic coupling or the like, for example operative for coupling the copying drum to a drive motor or for coupling to the copying drum components which are driven through the intermediary of the copying drum. Thus, when switch 28 opens during the ready intervals, switch 25 closes, energizing motor 15 and causing the fusing roller 2 and counterpressure roller 10 both to turn at low speed during the ready intervals.

A word should be said concerning the meaning of the ready intervals. In conventional copying machines, the ready intervals are the intervals during which the copying machine is awaiting a copying command from the operator. For example, if the operator commands the production of one copy from a particular original, the machine produces that copy and the machine then converts into its ready mode, awaiting another copying command from the operator; during the ready interval, the main drive mechanism of the machine may automatically shut off, e.g., the copying drum stop rotating. During the ready interval in a copying machine provided with a conventional fusing arrangement of the type in question, the fusing roller and counterpressure rollers are at a standstill. If the operator commands the production of plural copies from a single original, then the ready interval, i.e., the interval during which the rollers of a conventional fusing arrangement would be at a standstill, does not set in until the commanded number of copies have been produced, i.e., until the copying machine begins to await another copying command from the operator.

It will be understood that each of the elements described above, or two or more together, may also find a useful application in other types of constructions and circuits differing from the types described above.

While the invention has been illustrated and described as embodied in fusing arrangements of particular design, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a xerographic copying machine, an improved fusing arrangement of the type comprising a heated fusing roller and an unheated counterpressure roller between which copy paper bearing toner images to be fused is transported with the toner image in contact with the peripheral surface of the heated fusing roller and a drive mechanism for driving the rollers during copying operations, the improvement comprising means, operative during the stand-by intervals during which the copying machine awaits a copying command, for rotating the counterpressure roller so as to prevent non-uniform heating of the peripheral surface of the unheated counterpressure roller by heat radiating from the heated fusing roller, said means including an auxiliary drive separate from said drive mechanism and serving to steadily rotate said counterpressure roller at a rotary speed lower than the speed at which the counterpressure roller is rotated during copying operations.

2. In a machine as defined in claim 1, the counterpressure roller being swingably mounted for swinging motion towards and away from the heated fusing roller, the counterpressure roller being swung to the fusing roller during copying operations and swung away from the fusing roller during ready intervals, said means being operative for rotating the counterpressure roller when the counterpressure roller is swung away from the fusing roller.

3. In a machine as defined in claim 2, said means comprising a driving member, the counterpressure roller when swung away from the fusing roller coming into driven engagement with the driving member.

4. In a machine as defined in claim 1, said means including an overrunning clutch having an output driving the counterpressure roller and having an input and means driving the input of the overrunning clutch, whereby if during the stand-by intervals a sheet must be removed from between the fusing and counterpressure rollers in a sense rotating the rollers in the direction opposite to that in which they are driven, the rollers can nevertheless freely turn in such opposite direction even if the means driving the input of the overrunning clutch is running.

5. In a machine as defined in claim 1, said drive mechanism including an overrunning clutch and a drive member driving the rollers during copying operations through the intermediary of the overrunning clutch, whereby during the ready intervals when said means is rotating the counterpressure roller the transmission of rotation to the counterpressure roller is not accompanied by transmission of rotation to said drive member.

6. In a machine as defined in claim 1, said means being operative for steadily rotating the counterpressure roller during the ready intervals at a rotary speed lower than the speed at which the counterpressure roller is rotated during copying operations, said drive mechanism including an overrunning clutch and a drive member driving the rollers during copying operations through the intermediary of the overrunning clutch, whereby if said means is running during copying operations its rotation is nevertheless transmitted to the rollers only from said drive member whereas said means inherently commences to drive the counterpressure roller when after a copying operation the drive member ceases to drive the rollers.

7. In a machine as defined in claim 1, said auxiliary drive comprising a motor.

8. In a machine as defined in claim 7, furthermore including means for deenergizing the auxiliary drive motor during copying operations.

* * * * *